US010684076B2

(12) United States Patent
Wong

(10) Patent No.: US 10,684,076 B2
(45) Date of Patent: Jun. 16, 2020

(54) AIR CONDITIONING TOWER

(71) Applicant: Lee Wa Wong, Monterey Park, CA (US)

(72) Inventor: Lee Wa Wong, Monterey Park, CA (US)

( * ) Notice: Subject to any disclaimer, the term of this patent is extended or adjusted under 35 U.S.C. 154(b) by 69 days.

(21) Appl. No.: 15/751,856

(22) PCT Filed: Aug. 11, 2015

(86) PCT No.: PCT/US2015/044729

§ 371 (c)(1),
(2) Date: Feb. 10, 2018

(87) PCT Pub. No.: WO2017/027021

PCT Pub. Date: Feb. 16, 2017

(65) Prior Publication Data

US 2018/0231321 A1 Aug. 16, 2018

(51) Int. Cl.

| | |
|---|---|
| ***F28D 5/02*** | (2006.01) |
| ***F24F 1/02*** | (2019.01) |
| ***F28F 19/02*** | (2006.01) |
| *F28D 21/00* | (2006.01) |
| *F28F 25/00* | (2006.01) |

(52) U.S. Cl.

CPC ..... *F28D 5/02* (2013.01); *F24F 1/02* (2013.01); *F28F 19/02* (2013.01); *F28D 21/0017* (2013.01); *F28F 2025/005* (2013.01)

(58) Field of Classification Search

CPC .. F28D 5/02; F28D 21/007; F24F 1/02; F24F 5/0035; F28F 17/00; F28F 17/005; F28F 19/02; F28F 2025/005; F25B 2339/041; F25D 21/14

See application file for complete search history.

(56) References Cited

U.S. PATENT DOCUMENTS

2008/0087030 A1* 4/2008 Park ..... F01C 21/02 62/175
2013/0276476 A1* 10/2013 Wong ..... F28F 25/04 62/513

* cited by examiner

*Primary Examiner* — Marc E Norman
(74) *Attorney, Agent, or Firm* — Tsz Lung Yeung

(57) ABSTRACT

An air conditioning tower includes a tower casing, a compressor provided in the tower casing, a heat exchanger provided in the tower casing and connected to the compressor, an evaporative cooling system which includes at least one multiple-effect evaporative condenser, and a centrifugal fan. The multiple-effect evaporative condenser includes a pumping device, a first cooling unit, a second cooling unit, and a bottom water collecting basin. The first cooling unit includes a first water collection basin, a plurality of first heat exchanging pipes, and a first fill material unit. The second cooling unit includes a second water collection basin, a plurality of second heat exchanging pipes, and a second fill material unit.

36 Claims, 12 Drawing Sheets

AIR CONDITIONING TOWER

BACKGROUND OF THE PRESENT INVENTION

Field of Invention

The present invention relates to an air conditioning system, and more particularly to an air conditioning tower which has a single structure and provides a cooling effect to a large area without using extensive piping network.

Description of Related Arts

As shown in FIG. 1 of the drawings, a conventional split-type air conditioning system usually comprises an indoor air conditioning unit 100P and an outdoor compressor unit 200P. The indoor air conditioning unit 100P is located indoor while the outdoor compressor unit 200P is positioned in outdoor environment. They are connected by a plurality of ducts 300P.

There are several disadvantages associated with the above-mentioned split-type air conditioning system. First, a conventional split-type air conditioning system must involve circulation of refrigerant between the indoor air conditioning unit 100P and the outdoor compressor unit 200P. The refrigerant carries heat from an indoor space and release heat to the outdoor environment. Cooling of the refrigerant is through heat exchange between the refrigerant and ambient air. Very often, the Coefficient of Performance (C.O.P) of a typical split-type air conditioning system is not high (usually around 3.0-3.2). The efficiency of the evaporator used in the split-type air conditioning system is also very low.

Second, although a split-type air conditioning system may have some advantages in some circumstances, the use of ducts 300P in connecting the indoor air conditioning unit 100P and the outdoor compressor unit 200P means that a substantial amount of energy is lost or wasted during circulation of refrigerant. Furthermore, a substantial amount of raw material must be used to build the ducts 300P.

Third, since the indoor air conditioning unit 100P and the outdoor compressor unit 200P are located in different parts of a premises, this makes installation and maintenance of the split-type air conditioning system very difficult. In some situations, technicians may not be able to access the outdoor compressor unit 200P because it may be blocked by some other obstacles.

SUMMARY OF THE PRESENT INVENTION

An objective of the present invention is to provide an air conditioning tower which has a single casing structure and provides a cooling effect to a large area without using extensive piping network.

Another objective of the present invention is to provide an air conditioning tower comprising a plurality of water collection basins which are capable of effectively and evenly guiding cooling water to perform heat exchange with heat exchanging pipes.

Another objective of the present invention is to provide an air conditioning tower which can be easily and conveniently installed on a wall structure. Notably, the air conditioning tower of the present invention may stand on a ground surface so that mounting procedures of the present invention can be kept to the minimum.

In one aspect of the present invention, the present invention provides an air conditioning tower, comprising:

a tower casing having a front portion, a rear portion, a first side portion, a second side portion, and a receiving cavity;

a compressor provided in the tower casing;

a heat exchanger provided in the receiving cavity of the tower casing and connected to the compressor, the heat exchanger extending across the front portion, the first side portion, and the second side portion of the tower casing;

an evaporative cooling system which comprises at least one multiple-effect evaporative condenser provided at least one of the first side portion and the second side portion of the tower casing, the multiple-effect evaporative condenser having an air inlet side and an opposed air outlet side, and comprising;

a pumping device provided at the bottom portion of the tower casing and adapted for pumping a predetermined amount of cooling water at a predetermined flow rate;

a first cooling unit, comprising:

a first water collection basin for collecting the cooling water from the pumping device;

a plurality of first heat exchanging pipes connected to heat exchanger and immersed in the first water collection basin; and a first fill material unit provided underneath the first heat exchanging pipes, wherein the cooling water collected in the first water collection basin is arranged to sequentially flow through exterior surfaces of the first heat exchanging pipes and the first fill material unit;

a second cooling unit, comprising:

a second water collection basin positioned underneath the first cooling unit for collecting the cooling water flowing from the first cooling unit;

a plurality of second heat exchanging pipes immersed in the second water collection basin and connected to the heat exchanger; and a second fill material unit provided underneath the second heat exchanging pipes, wherein the cooling water collected in the second water collection basin is arranged to sequentially flow through exterior surfaces of the second heat exchanging pipes and the second fill material unit; and a bottom water collecting basin positioned underneath the second cooling unit for collecting the cooling water flowing from the second cooling unit, the cooling water collected in the bottom water collection basin being arranged to be guided to flow back into the first water collection basin of the first cooling unit, a predetermined amount of refrigerant circulating between the compressor, the heat exchanger, and the evaporative cooling system, the refrigerant from the heat exchanger being arranged to flow through the first heat exchanging pipes of the first cooling unit and the second heat exchanging pipes of the second cooling unit in such a manner that the refrigerant is arranged to perform highly efficient heat exchanging process with the cooling water for lowering a temperature of the refrigerant, a predetermined amount of air being drawn from the air inlet side for performing heat exchange with the cooling water flowing through the first fill material unit and the second fill material unit for lowering a temperature of the cooling water, the air having absorbed the heat from the cooling water being discharged out of the first fill material unit and the second fill material unit through the air outlet side; and a centrifugal fan provided in the tower casing for drawing air to flow from the air inlet side to the air outlet side.

In another aspect of the present invention, the present invention provides a water collection basin for a multiple-effect evaporative condenser, comprising:

an inner basin member which comprises an inner sidewall, an inner bottom wall extended from the inner sidewall, and a guiding wall extended from the inner bottom wall so that the inner bottom wall is extended between the inner sidewall and the guiding wall; and a first outer basin member, which comprises an outer sidewall and an outer bottom wall extended from the outer sidewall at a position underneath the inner bottom wall to form a substantially L-shaped cross section of the outer basin member, a height of the outer sidewall being greater than that of the guiding wall, the water collection basin having a plurality of passage holes spacedly formed on the outer bottom wall.

DETAILED DESCRIPTION OF THE PREFERRED EMBODIMENT

Figure 1:
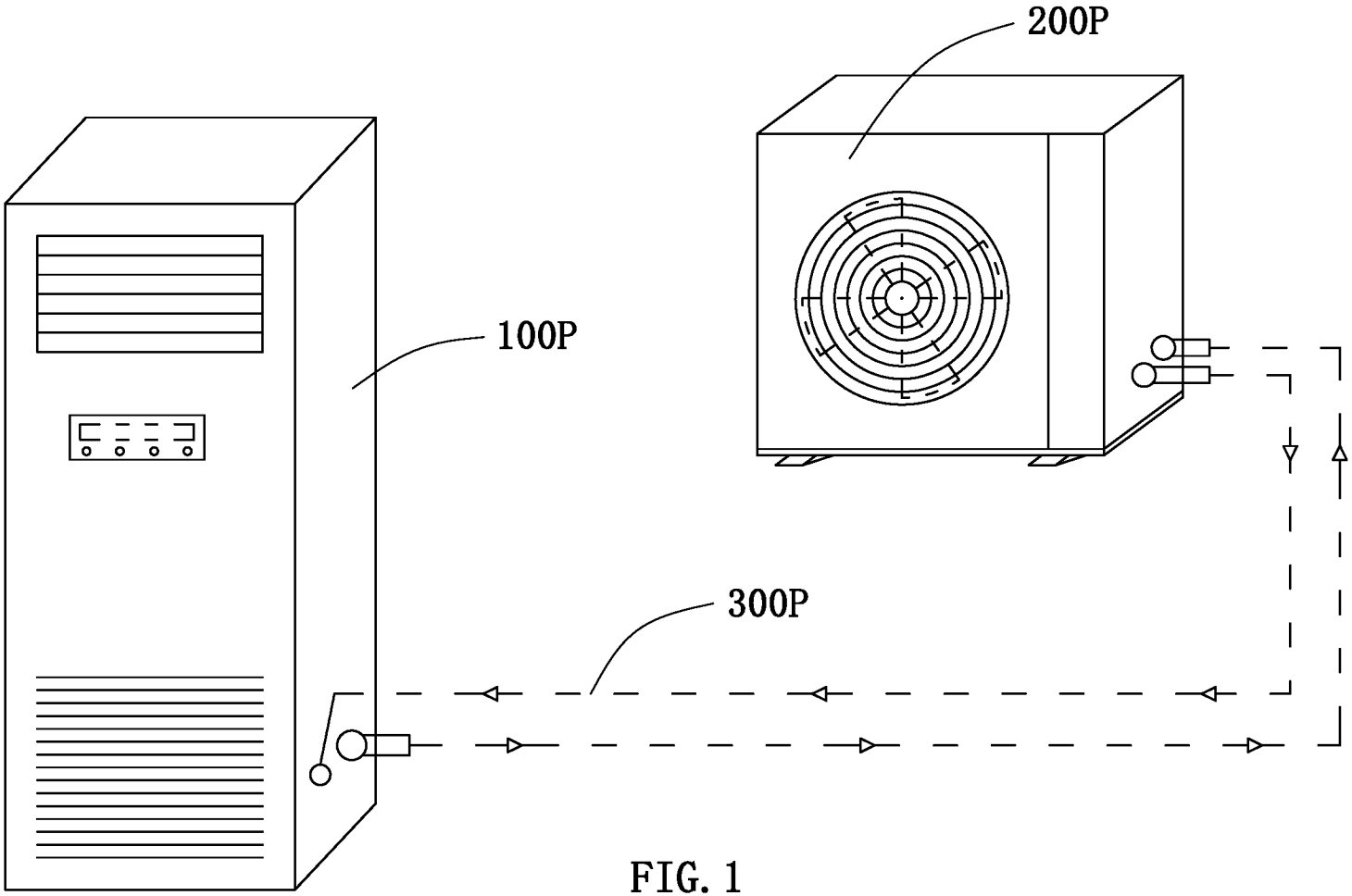
FIG. 1 PRIOR ART
FIG. 1 is a conventional split-type air conditioning unit.

The following detailed description of the preferred embodiment is the preferred mode of carrying out the invention. The description is not to be taken in any limiting sense. It is presented for the purpose of illustrating the general principles of the present invention.

Referring to FIG. 2 to FIG. 4, FIG. 5A, FIG. 5B and FIG. 6 to FIG. 11 of the drawings, an air conditioning tower according to a preferred embodiment of the present invention is illustrated. Broadly, the air conditioning tower comprises a tower casing 10, a compressor 20 having a compressor outlet 21 and a compressor inlet 22, a heat exchanger 30 having a heat exchanging outlet 31 and a heat exchanging inlet 32, an evaporative cooling system 400, and a centrifugal fan 50. A predetermined amount of refrigerant is circulating between these components, preferably through connecting pipes or heat exchanging pipes which is described below.

The tower casing 10 has a front portion 103, a rear portion 104, a first side portion 105, and a second side portion 106 which is opposite to the first side portion 105, and a receiving cavity 108. The compressor 20 is provided in receiving cavity 108 of the tower casing 10.

The heat exchanger 30 is provided in the receiving cavity 108 of the tower casing 10 and connected to the compressor 20. The heat exchanger 30 extends across the front portion 103, the first side portion 105, and the second side portion 106 of the tower casing 10. The heat exchanger 30 is positioned in front of the evaporative cooling system 400.

The evaporative cooling system 400 comprises at least one multiple-effect evaporative condenser 40 provided on at least one of the first side portion 105 and the second side portion 106 of the tower casing 10. The multiple-effect evaporative condenser 40 has an air inlet side 41 and an opposed air outlet side 42 and comprises a pumping device 43, a first cooling unit 6, a second cooling unit 7, and a bottom water collection basin 46.

The pumping device 43 is provided on a bottom panel 102 of the tower casing 10 and is adapted for pumping a predetermined amount of cooling water at a predetermined flow rate.

The first cooling unit 6 comprises a first water collection basin 61, a plurality of first heat exchanging pipes 62 and a first fill material unit 63. The first water collection basin 61 is for collecting the cooling water from the pumping device 43. The plurality of first heat exchanging pipes 62 are connected to heat exchanger 30 and is immersed in the first water collection basin 61. A predetermined amount of refrigerant circulates between the heat exchanger 30 and the first heat exchanging pipes 62. The first fill material unit 63 is provided underneath the first heat exchanging pipes 62, wherein the cooling water collected in the first water collection basin 61 is arranged to sequentially flow through exterior surfaces of the first heat exchanging pipes 62 and the first fill material unit 63.

The second cooling unit 7 comprises a second water collection basin 71, a plurality of second heat exchanging pipes 72, and a second fill material unit 73. The second water collection basin 71 is positioned underneath the first cooling unit 6 for collecting the cooling water flowing from the first cooling unit 6. The plurality of second heat exchanging pipes 72 are immersed in the second water collection basin 71 and connected to the heat exchanger 30. The second fill material unit 73 is provided underneath the second heat exchanging pipes 72, wherein the cooling water collected in the second water collection basin 71 is arranged to sequentially flow through exterior surfaces of the second heat exchanging pipes 72 and the second fill material unit 73.

The bottom water collecting basin 46 is positioned underneath the lowest cooling unit (i.e. the second cooling unit 7 in this example) for collecting the cooling water flowing from the second cooling unit 7.

The cooling water collected in the bottom water collection basin 46 is arranged to be guided to flow back into the first water collection basin 61 of the first cooling unit 6. At the same time, a predetermined amount of refrigerant circulating between the compressor 20, the heat exchanger 30, and the evaporative cooling system 400. The refrigerant from the heat exchanger 30 is arranged to flow through the first heat exchanging pipes 62 of the first cooling unit 6 and the second heat exchanging pipes 72 of the second cooling unit 7 in such a manner that the refrigerant is arranged to perform highly efficient heat exchanging process with the cooling water for lowering a temperature of the refrigerant. A predetermined amount of air being drawn from the air inlet side 41 for performing heat exchange with the cooling water flowing through the first fill material unit 63 and the second fill material unit 73 for lowering a temperature of the cooling water. The air having absorbed the heat from the cooling water is discharged out of the first fill material unit 63 and the second fill material unit 73 through the air outlet side 42.

Accordingly, the tower casing 10 further has at least one side opening 109 which communicates the air inlet side 41 with an exterior of the tower casing 10.

The centrifugal fan 50 is provided in the tower casing 10 for drawing air to flow from the air inlet side 41 to the air outlet side 42. Thus, the tower casing 10 may have a rear opening 1091 which communicates the air outlet side 42 with an exterior of the tower casing 10.

According to the preferred embodiment of the present invention, the tower casing 10 comprises a top panel 101, a bottom panel 102, a front panel 1031 formed on the front portion 103, a rear panel 1041 formed on the rear portion 104, a first side panel 1051 formed on the first side portion 105, and a second side panel 1061 formed on the second side portion 106. The receiving cavity 108 is formed between the top panel 101, the bottom panel 1021, the front panel 1031, the rear panel 1041, the first side panel 1051 and the second side panel 1061.

Figure 2:
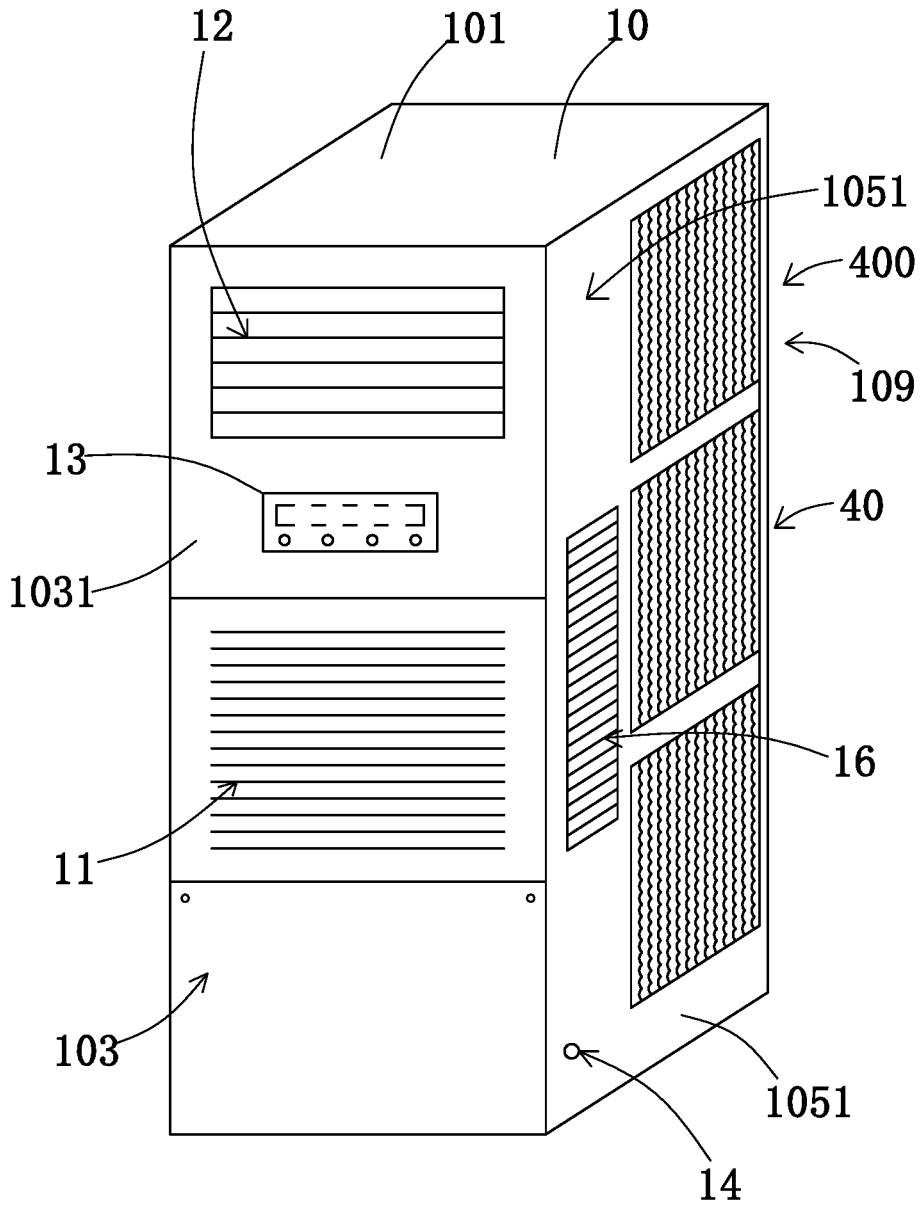
FIG. 2 is a perspective view of an air conditioning tower according to a preferred embodiment of the present invention.
Figure 3:
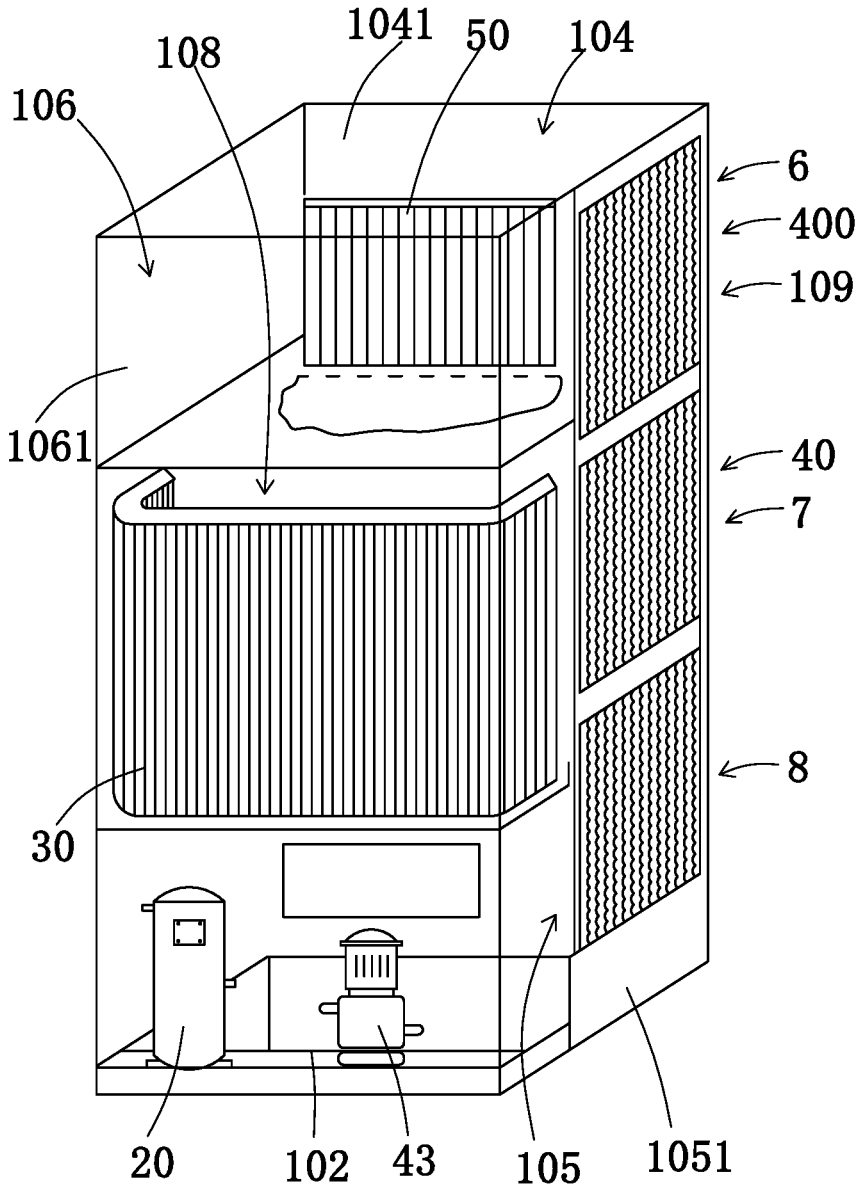
FIG. 3 is a perspective view of the air conditioning tower according to a preferred embodiment of the present invention, illustrating the internal structure of the air conditioning tower.
Figure 4:
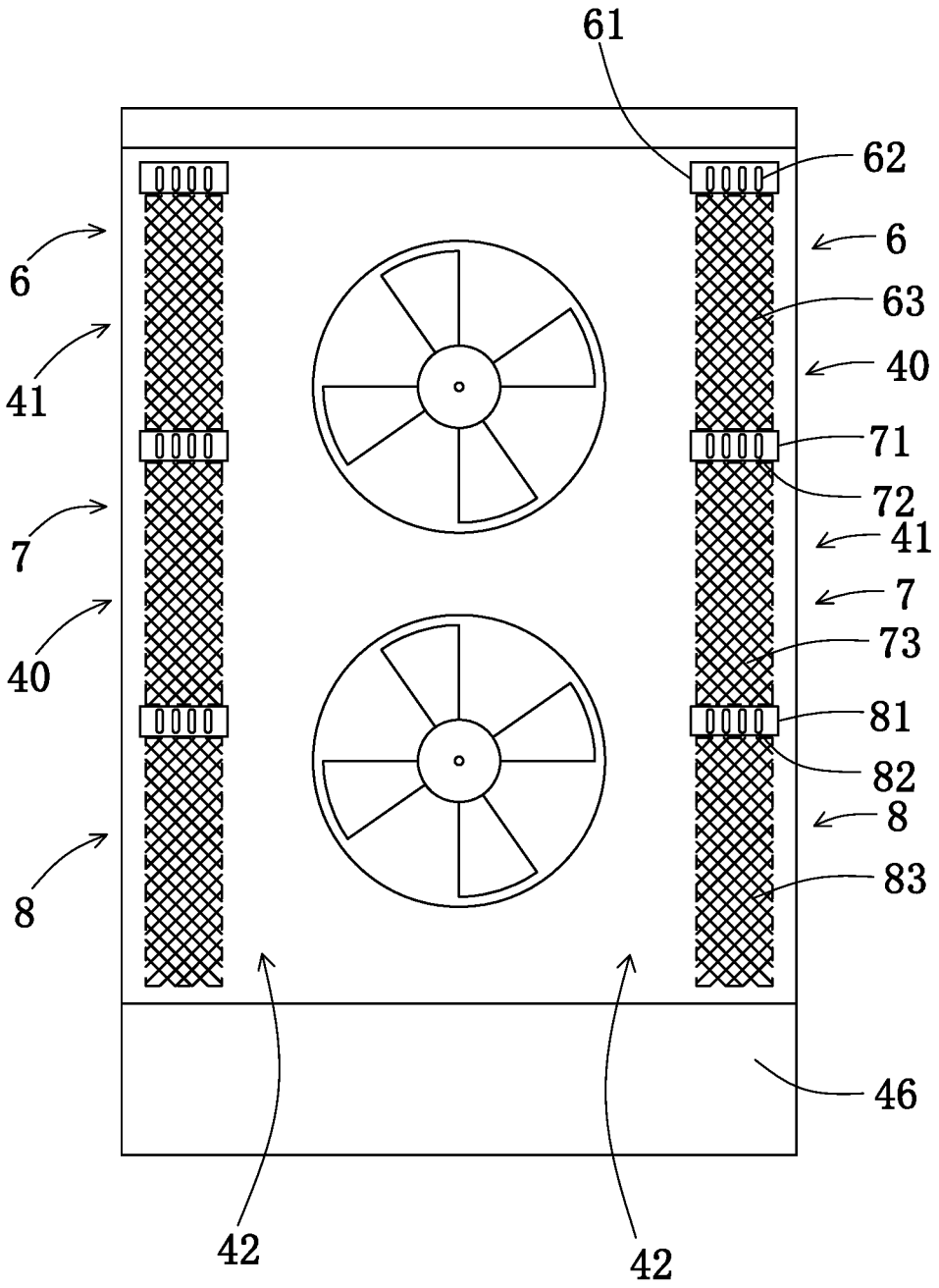
FIG. 4 is a rear view of the air conditioning tower according to a preferred embodiment of the present invention, illustrating the structure in a tower casing of the air conditioning tower when viewed from a rear side thereof.

As shown in FIG. 2 to FIG. 4 of the drawings, the evaporative cooling system 400 may comprise two multiple-effect evaporative condensers 40 accommodated at two side portions 105, 106 of the tower casing 10 respectively. The tower casing 10 has a generally rectangular cross sectional shape.

It is important to mention, however, that the particular arrangement of multiple-effect evaporative condensers 40 may vary depending on the circumstances in which the air conditioning tower is operated.

Referring to FIG. 4 of the drawings, two multiple-effect evaporative condensers 40 are illustrated. Each of the multiple-effect evaporative condensers 40 actually comprises a plurality of cooling units (in additional to the first cooling unit 6 and the second cooling unit 7 described above) positioned between the first water collection basin 61 and the bottom water collection basin 46. FIG. 3 and FIG. 4 illustrate that a third cooling unit 8 may be provided underneath the second cooling unit 7.

As shown in FIG. 2 of the drawings, the tower casing 10 further has a return air inlet 11, an air delivery outlet 12, and a control panel 13 provided on the front panel 1031 of the tower casing 10. Moreover, the tower casing 10 may further have a cooling water inlet 14 formed one of the first side panel 1051 and the second side panel 1061.

For each of the multiple-effect evaporative condensers 40, the pumping device 43 may be positioned in the bottom panel 102 of the tower casing 10, and is connected to the first water collection basin 61 through a water pipe 45.

According to the preferred embodiment of the present invention, each of the multiple-effect evaporative condensers 40 comprises first through third cooling units 6, 7, 8. The number of cooling units utilized depend on the circumstances in which the air conditioning tower is operated.

When the cooling water passes through one cooling unit, its temperature is arranged to increase by absorbing heat from the relevant heat exchanging pipes and is to be lowered by a predetermined temperature gradient by extracting heat to the ambient air (referred to as one "temperature cooling effect" on the cooling water), so that if the cooling water passes through three cooling units 6, 7, 8, the multiple-effect evaporative condenser 40 has a total of three temperature effects on the cooling water because the cooling water is heated up by the heat exchanging pipes three times and cooled down by the ambient air in the relevant fill material unit three times. Referring to FIG. 4 of the drawings, the third cooling unit 8 comprises a third water collection basin 81, a plurality of third heat exchanging pipes 82 immersed in the third water collection basin 81, and a third fill material unit 83 provided under the third water collection basin 81.

Figure 5A:
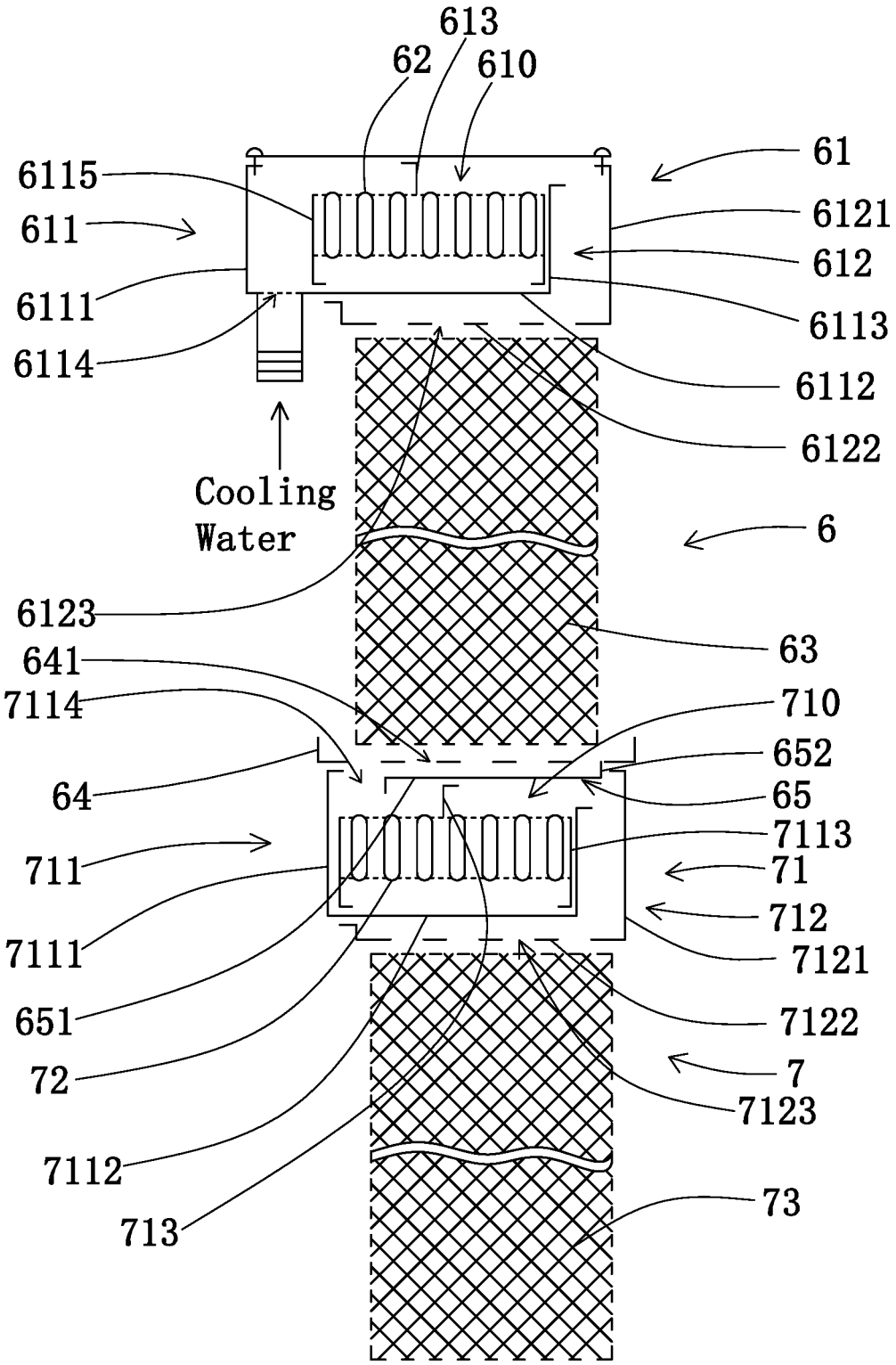
FIG. 5A is a first schematic diagram of a first cooling unit and a second cooling unit of the air conditioning tower according to a preferred embodiment of the present invention.

As shown in FIG. 5A of the drawings, the first water collection basin 61 has a first heat exchanging cavity 610 and comprises a first inner basin member 611, and a first outer basin member 612. The first inner basin member 611 comprises a first inner sidewall 6111 and a first inner bottom wall 6112 extended from the first inner sidewall 6111 to form a substantially L-shape cross section of the first inner basin member 611. The first inner basin member 611 further comprises a first guiding wall 6113 extended from the first inner bottom wall 6112 so that the first inner bottom wall 6112 is extended between the first inner sidewall 6111 and the first guiding wall 6113. Moreover, the first inner basin member 611 has a first water inlet 6114 connected to the corresponding pumping device 43 so that the cooling water from the bottom water collection basin 46 may be pumped up to the first water collection basin 61 through said first water inlet 6114. The first heat exchanging pipes 62 are provided within the first inner basin member 611. The first inner basin member 611 further comprises an inner partitioning wall 6115 upwardly extended from the first inner bottom wall 6112 at a position spacedly apart from the first inner sidewall 6111. The first water inlet 6114 is formed at a bottom side of the first inner basin member 611 at a position between the first inner sidewall 6111 and the inner partitioning wall 6115.

On the other hand, the first outer basin member 612 comprises a first outer sidewall 6121 and a first outer bottom wall 6122 extended from the first outer sidewall 6121 to form a substantially L-shaped cross section of the first outer basin member 612. As shown in FIG. 5A of the drawings, a height of the first outer sidewall 6121 is greater than that of the first guiding wall 6113. Similarly, a height of the first inner sidewall 6111 is greater than that of the inner partitioning wall 6115. The first heat exchanging pipes 62 are accommodated in a space between the inner partitioning wall 6115 and the first guiding wall 6113.

The first water collection basin 61 further comprises a first water diverting panel 613 provided in the first inner basin member 611 at a position above the first heat exchanging pipes 62 for diverting a water flowing route of the cooling water. The first water diverting panel 613 is positioned such that a predetermined number of heat exchanging pipes 62 are positioned on one side of the first water diverting panel 613, while the remaining first heat exchanging pipes 62 are positioned on the other side of the first water diverting panel 613.

The cooling water first enters the first water collection basin 61 through the first water inlet 6114. The cooling water then passes through the space formed between the first inner sidewall 6111 and the inner partitioning wall 6115. The cooling water then flows over the inner partitioning wall 6115 and come into contact with those of the first heat exchanging pipes 62 which are positioned at one side of the first water diverting panel 613. The first water diverting panel 613 blocks and diverts all the cooling water from passing it and therefore forces all the cooling water flow toward the first inner bottom wall 6112 and come into contact with those first heat exchanging pipes 62 which are at the other side of the first water diverting panel 613.

In other words, the first water diverting panel 613 divides the first heat exchanging pipes 62 into two groups, one of which are positioned at one side of the first water diverting panel 613, and the other group is positioned at another side of the first water diverting panel 613. The first water diverting panel 613 diverts all cooling water to subsequently flow through one group of the first heat exchanging pipes 62 and then the other. The number of first heat exchanging pipes 62 in each group may be varied and determined by the circumstances in which the present invention is operated.

After flowing through the first group of the first heat exchanging pipes 62, the cooling water is guided to flow along the first inner bottom wall 6112 and pass through the first heat exchanging pipes 62 which are positioned on the other side of the first water diverting panel 613 (the second group). When the cooling water fills up the space formed between the inner partitioning member 6115 and the first guiding wall 6113, the cooling water then flows over the top of the first guiding wall 6113, and flows through a channel formed between the first guiding wall 6113 and the first outer sidewall 6121 and eventually reaches the first outer bottom wall 6122, which is positioned underneath the first inner bottom wall 6112.

The first water collection basin 61 may further have a plurality of first passage holes 6123 spacedly formed on the first outer bottom wall 6122 for allowing the cooling water to flow to the first fill material unit 63 through the first passage holes 6123.

As shown in FIG. 5A of the drawings, the first cooling unit 6 may further comprise a first guiding tray 64 provided underneath the first fill material unit 63, and a first guiding panel 65 provided underneath the first guiding tray 64 for guiding a flowing path of the cooling water coming from the first fill material unit 63. Specifically, the first guiding tray 64 has a plurality of first guiding holes 641 formed thereon, wherein the cooling water coming from the first fill material unit 63 is arranged to evenly pass through the first guiding holes 641. The first guiding panel 65 may comprise a first panel member 651, and a first blocking member 652 upwardly extended from an end of the first panel member 651. The other end of the first panel member 651 is a free end. The first guiding panel 65 may be mounted underneath the first guiding tray 64 in such a manner that the cooling water flowing on the guiding panel 65 is allowed to flow into the second cooling unit 7 only through the free end of the first panel member 651. The cooling water reaching the first blocking member 652 will be blocked to flow toward the free end of the first panel member 651.

The construction of the second water collection basin 71 is similar to that of the first water collection basin 61 except the absence of the inner partitioning wall 6115. As shown in FIG. 5A of the drawings, the second water collection basin 71 has a second heat exchanging cavity 710 and comprises a second inner basin member 711, and a second outer basin member 712. The second inner basin member 711 comprises a second inner sidewall 7111 and a second inner bottom wall 7112 extended from the second inner sidewall 7111 to form a substantially L-shape cross section of the second inner basin member 711. The second inner basin member 711 further comprises a second guiding wall 7113 extended from the second inner bottom wall 7112 so that the second inner bottom wall 7112 is extended between the second inner sidewall 7111 and the second guiding wall 7113. Moreover, the second inner basin member 711 has a second water inlet 7114 for allowing the cooling water from the first cooling unit 6 to flow into the second water collection basin 71. The second heat exchanging pipes 72 are provided within the second inner basin member 711. The second water inlet 7114 is formed at a top side of the second inner basin member 711.

On the other hand, the second outer basin member 712 comprises a second outer sidewall 7121 and a second outer bottom wall 7122 extended from the second outer sidewall 7121 to form a substantially L-shaped cross section of the second outer basin member 712. As shown in FIG. 5A of the drawings, a height of the second outer sidewall 7121 is greater than that of the second guiding wall 7113. The second heat exchanging pipes 72 are accommodated in a space between the second inner sidewall 7111 and the second guiding wall 7113.

The second water collection basin 71 further comprises a second water diverting panel 713 provided in the second inner basin member 711 at a position above the second heat exchanging pipes 72 for diverting a water flowing route of the cooling water. The second water diverting panel 713 is positioned such that a predetermined number of heat exchanging pipes 72 are positioned on one side of the second water diverting panel 713, while the remaining second heat exchanging pipes 72 are positioned on the other side of the second water diverting panel 713.

The cooling water second enters the second water collection basin 71 through the second water inlet 7114. The cooling water then comes into contact with those of the second heat exchanging pipes 72 which are positioned at one side of the second water diverting panel 713. The second water diverting panel 713 blocks and diverts all the cooling water from passing it and therefore forces all the cooling water flow toward the second inner bottom wall 7112 and come into contact with those second heat exchanging pipes 72 which are at the other side of the second water diverting panel 713.

In other words, the second water diverting panel 713 divides the second heat exchanging pipes 72 into two groups, one of which are positioned at one side of the second water diverting panel 713, and the other group is positioned at another side of the second water diverting panel 713. The second water diverting panel 713 diverts all cooling water to subsequently flow through one group of the second heat exchanging pipes 72 and then the other. The number of second heat exchanging pipes 72 in each group may be varied and determined by the circumstances in which the present invention is operated.

After flowing through the second group of the second heat exchanging pipes 72, the cooling water is guided to flow along the second inner bottom wall 7112 and pass through the second heat exchanging pipes 72 which are positioned on the other side of the second water diverting panel 713 (the second group). When the cooling water fills up the space formed between the second inner sidewall 7111 and the second guiding wall 7113, the cooling water then flows over the top of the second guiding wall 7113, and flows through a channel formed between the second guiding wall 7113 and the second outer sidewall 7121 and eventually reaches the second outer bottom wall 7122, which is positioned underneath the second inner bottom wall 7112.

The second water collection basin 71 may further have a plurality of second passage holes 7123 spacedly formed on the second outer bottom wall 7122 for allowing the cooling water to flow to the second fill material unit 73 through the second passage holes 7123.

Figure 5B:
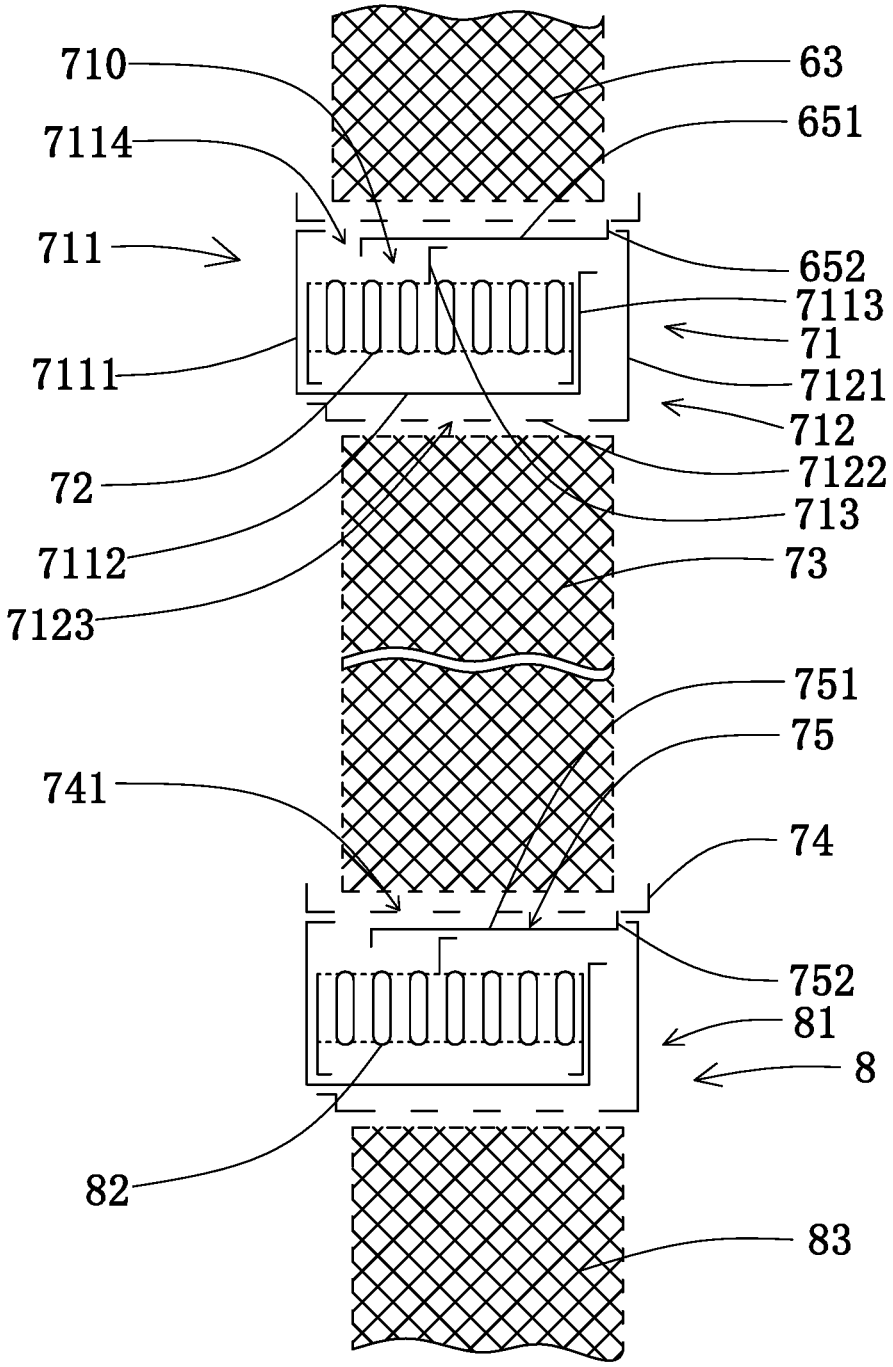
FIG. 5B is a second schematic diagram of a first cooling unit and a second cooling unit of the air conditioning tower according to a preferred embodiment of the present invention.

As shown in FIG. 5B of the drawings, the second cooling unit 7 may further comprise a second guiding tray 74 provided underneath the second fill material unit 73, and a second guiding panel 75 provided underneath the guiding tray 74 for guiding a flowing path of the cooling water coming from the second fill material unit 73. Specifically, the second guiding tray 74 has a plurality of second guiding holes 741 formed thereon, wherein the cooling water coming from the second fill material unit 73 is arranged to evenly pass through the second guiding tray 74 through the second guiding holes 741. The second guiding panel 75 may comprise a second panel member 751, a second blocking member 752 upwardly extended from an end of the second panel member 751. The other end of the second panel member 751 is a free end. The second guiding panel 75 may be mounted underneath the second guiding tray 74 in such a manner that the cooling water flowing on the guiding panel 75 is allowed to flow into the second cooling unit 7 only through the free end of the second panel member 751. The cooling water reaching the second blocking member 752 will be blocked to flow to the free end of the second panel member 751.

The third water collection basin 81 of the third cooling unit 8 is structurally identical to the second water collection basin 71 of the second cooling unit 7.

Figure 11:
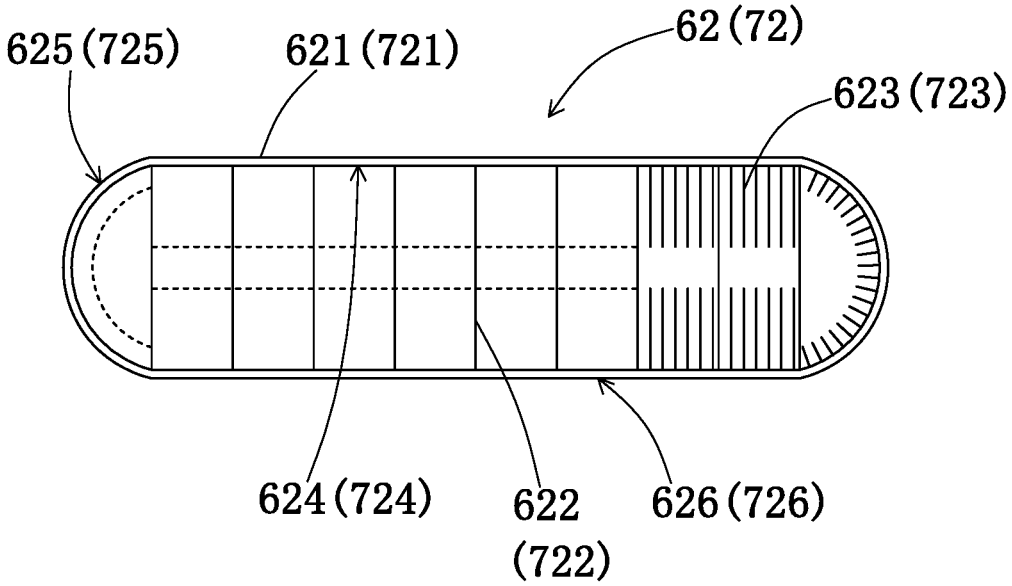
FIG. 11 is a sectional view of a heat exchanging pipe of the air conditioning tower according to a preferred embodiment of the present invention.

Referring to FIG. 11 of the drawings, each of the first heat exchanging pipes 62 comprises a first pipe body 621 and a plurality of first retention members 622 spacedly formed in the first pipe body 621, and a plurality of first heat exchanging fins 623 extended from an inner surface 624 of the first pipe body 621. Specifically, the first pipe body 621 has two curved side portions 625 and a substantially flat mid portion 626 extending between the two curved side portions 625 to form rectangular cross sectional shape at the mid portion 626 and two semicircular cross sectional shapes at two curved side portions 625 of the first heat exchanging pipe 62.

Furthermore, the first retention members 622 are spacedly distributed in the flat mid portion 626 along a transverse direction of the corresponding first pipe body 621 so as to form a plurality of first pipe cavities 627. Each of the first retention members 622 has a predetermined elasticity for reinforcing the structural integrity of the corresponding first heat exchanging pipe 62. On the other hand, each of the first heat exchanging fins 623 are extended from an inner surface of the first pipe body 621. The first heat exchanging fins 623 are spacedly and evenly distributed along the inner surface 624 of first pipe body 621 for enhancing heat exchange performance between the heat exchange fluid flowing through the corresponding first heat exchanging pipe 62 and the cooling water.

On the other hand, the second heat exchanging pipes 72 are structurally identical to the first heat exchanging pipes 62. Also referring to FIG. 11 of the drawings, each of the second heat exchanging pipes 72 comprises a second pipe body 721 and a plurality of second retention members 722 spacedly formed in the second pipe body 721, and a plurality of second heat exchanging fins 723 extended from an inner surface 724 of the second pipe body 721. Specifically, the second pipe body 721 has two curved side portions 725 and a substantially flat mid portion 726 extending between the two curved side portions 725 to form rectangular cross sectional shape at the mid portion 726 and two semicircular cross sectional shapes at two curved side portions 725 of the second heat exchanging pipe 72.

Furthermore, the second retention members 722 are spacedly distributed in the flat mid portion 726 along a transverse direction of the corresponding second pipe body 721 so as to form a plurality of second pipe cavities 727. Each of the second retention members 722 has a predetermined elasticity for reinforcing the structural integrity of the corresponding second heat exchanging pipe 72. On the other hand, each of the second heat exchanging fins 723 are extended from an inner surface of the second pipe body 721. The second heat exchanging fins 723 are spacedly and evenly distributed along the inner surface 724 of second pipe body 721 for enhancing heat exchange performance between the heat exchange fluid flowing through the corresponding second heat exchanging pipe 72 and the cooling water.

It is worth mentioning that when the multiple-effect evaporative condenser 400 comprises many cooling units, such as the above-mentioned first through third cooling units 6, 7, 8, the third heat exchanging pipes 82 are structurally identical to the first heat exchanging pipes 62 and the second heat exchanging pipes 72 described above.

According to the preferred embodiment of the present invention, each of the first through third heat exchanging pipes 62, 72, 82 are configured from aluminum which can be recycled and reused very conveniently and economically. In order to make the heat exchanging pipes to resist corrosion and unwanted oxidation, each of the heat exchanging pipes 62, 72, 82 has a thin oxidation layer formed on an exterior surface and an interior surface thereof for preventing further corrosion of the relevant heat exchanging pipe. The formation of this thin oxidation layer can be by anode oxidation method.

Moreover, each of the heat exchanging pipes 62, 72, 82 may also have a thin layer of polytetrafluoroethylene formed on an exterior surface and/or interior surface thereof to prevent unwanted substances from attaching on the exterior surfaces of the heat exchanging pipes 62, 72, 82.

Figure 6:
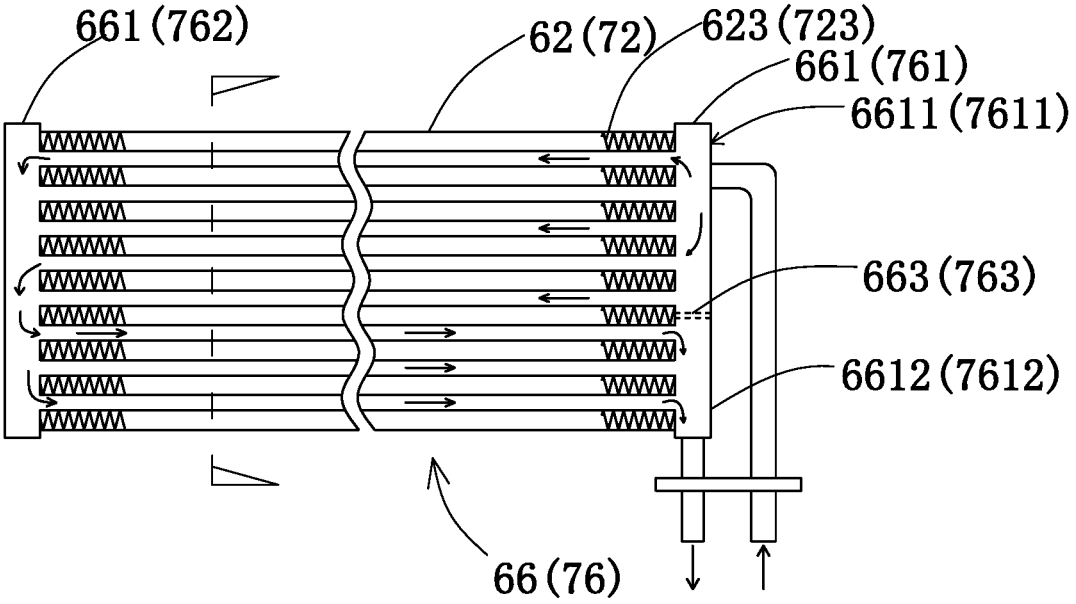
FIG. 6 is a schematic diagram of a plurality of heat exchanging pipes of the air conditioning tower according to a preferred embodiment of the present invention.
Figure 7:
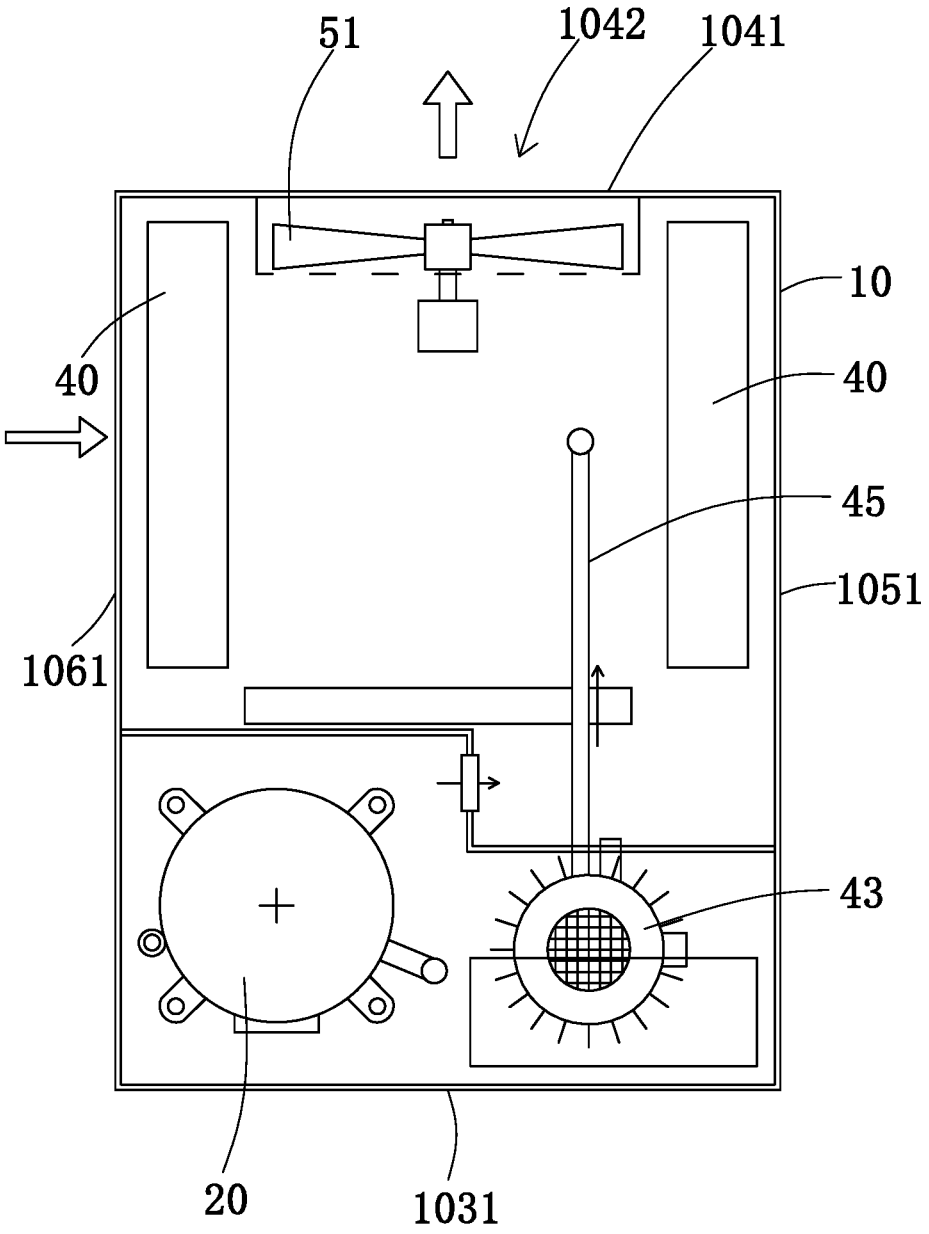
FIG. 7 is a sectional view of the air conditioning tower along line A-A of FIG. 2.

Referring to FIG. 6 of the drawings, it illustrates that the first heat exchanging pipes 62 and the second heat exchanging pipes 72 are connected in parallel. As a result, the heat exchange fluid enters the relevant multiple-effect evaporative condenser 40 and passes through the first through third heat exchanging pipes 62, 72, 82 at the same time. After passing through each of the first through third heat exchanging pipes 62, 72, 82, the temperature of the heat exchange fluid will be substantially lowered and the heat exchange fluid is arranged to exit the multiple-effect evaporative condenser 40.

Referring to FIG. 6 of the drawings, the first cooling unit 6 further comprises a first guiding system 66 connected to the first heat exchanging pipes 62 to divide the first heat exchanging pipes 62 into several piping groups so as to guide the refrigerant to flow through the various piping groups in a predetermined order.

Specifically, the first guiding system 66 comprises a first inlet collection pipes 661 extended between outer ends of the first heat exchanging pipes 62, and a first guiding pipe 662 extended between inner ends of the first heat exchanging pipes 62. Note that the first inlet collection pipe 661 and the first guiding pipe 662 are substantially parallel to each other. The first guiding system 66 may further comprise a first partitioning member 663 provided in the first inlet collection pipe 661 for blocking the refrigerant from passing through the first partitioning member 663. Thus, the first partitioning member 663 divides the first inlet collection pipe 661 into a first inlet section 6611 and a first outlet section 6612.

As shown in FIG. 5A and FIG. 6 of the drawings, there are eight first heat exchanging pipes 62 in the first cooling unit 6. The eight heat exchanging pipes 62 are divided into two piping groups in which each piping group contains four heat exchanging pipes 62 which are extended between a first inlet collection pipe 661 and a first guiding pipe 662.

The refrigerant from the compressor 20 is arranged to enter the four of the first heat exchanging pipes 62 (one group of the first heat exchanging pipes 62) through the first inlet section 6611 of the inlet collection pipes 661. The refrigerant is then arranged to flow through the corresponding first heat exchanging pipes 62 and perform heat exchange with the cooling water as described above. After that, the refrigerant is arranged to enter the first guiding pipe 662 and flow into another four of the first heat exchanging pipes 62 (the second group of the first heat exchanging pipes 62). After that, the refrigerant is guided to flow into the first outlet section 6612 of the first inlet collection pipe 661 and leave the first cooling unit 6.

In addition, the first guiding system 66 further comprises a plurality of first heat exchanging fins 623 extended between each two adjacent first heat exchanging pipes 62 for substantially increasing a surface area of heat exchange between the first heat exchanging pipes 62 and the cooling water, and for reinforcing a structural integrity of the first guiding system 66. These first heat exchanging fins 623 may be integrally extended from an outer surface of the first heat exchanging pipes 62, or externally attached or welded on the outer surfaces of the first heat exchanging pipes 62.

Similarly, the second cooling unit 7 further comprises a second guiding system 76 connected to the second heat exchanging pipes 72 to divide the second heat exchanging pipes 72 into several piping groups so as to guide the refrigerant to flow through the various piping groups in a predetermined order.

Specifically, the second guiding system 76 comprises a second inlet collection pipes 761 extended between outer ends of the second heat exchanging pipes 72, and a second guiding pipe 762 extended between inner ends of the second heat exchanging pipes 72. Note that the second inlet collection pipe 761 and the second guiding pipe 72 are substantially parallel to each other. The second guiding system 76 may further comprise a second partitioning member 763 provided in the second inlet collection pipe 761 for blocking the refrigerant from passing through the second partitioning member 763. Thus, the second partitioning member 763 divides the second inlet collection pipe 761 into a second inlet section 7611 and a second outlet section 7612.

As shown in FIG. 5A and FIG. 6 of the drawings, there are also eight second heat exchanging pipes 72 in the second cooling unit 7. The eight heat exchanging pipes 72 are divided into two piping groups in which each piping group contains four heat exchanging pipes 72 which are extended between a second inlet collection pipe 761 and a second guiding pipe 762.

The refrigerant from the heat exchange 20 is arranged to enter the four of the second heat exchanging pipes 72 (one group of the second heat exchanging pipes 72) through the second inlet section 7611 of the inlet collection pipes 761. The refrigerant is then arranged to flow through the corresponding second heat exchanging pipes 72 and perform heat exchange with the cooling water as described above. After that, the heat exchange fluid is arranged to enter the second guiding pipe 762 and flow into another four of the second heat exchanging pipes 72 (the second group of the second heat exchanging pipes 72). After that, the refrigerant is guided to flow into the second outlet section 7612 of the second inlet collection pipe 761 and leave the second cooling unit 7.

In addition, the second guiding system 76 further comprises a plurality of second heat exchanging fins 723 extended between each two adjacent second heat exchanging pipes 72 for substantially increasing a surface area of heat exchange between the second heat exchanging pipes 72 and the cooling water, and for reinforcing a structural integrity of the second guiding system 76. These second heat exchanging fins 723 may be integrally extended from an outer surface of the second heat exchanging pipes 72, or externally attached or welded on the outer surfaces of the second heat exchanging pipes 72.

It is important to mention that the above-mentioned configuration of the first guiding system 66, the second guiding system 76, the first heat exchanging pipes 62, the second heat exchanging pipes 72, and the number of piping groups are for illustrative purpose only and can actually be varied according to the circumstances in which the present invention is operated.

Figure 8:
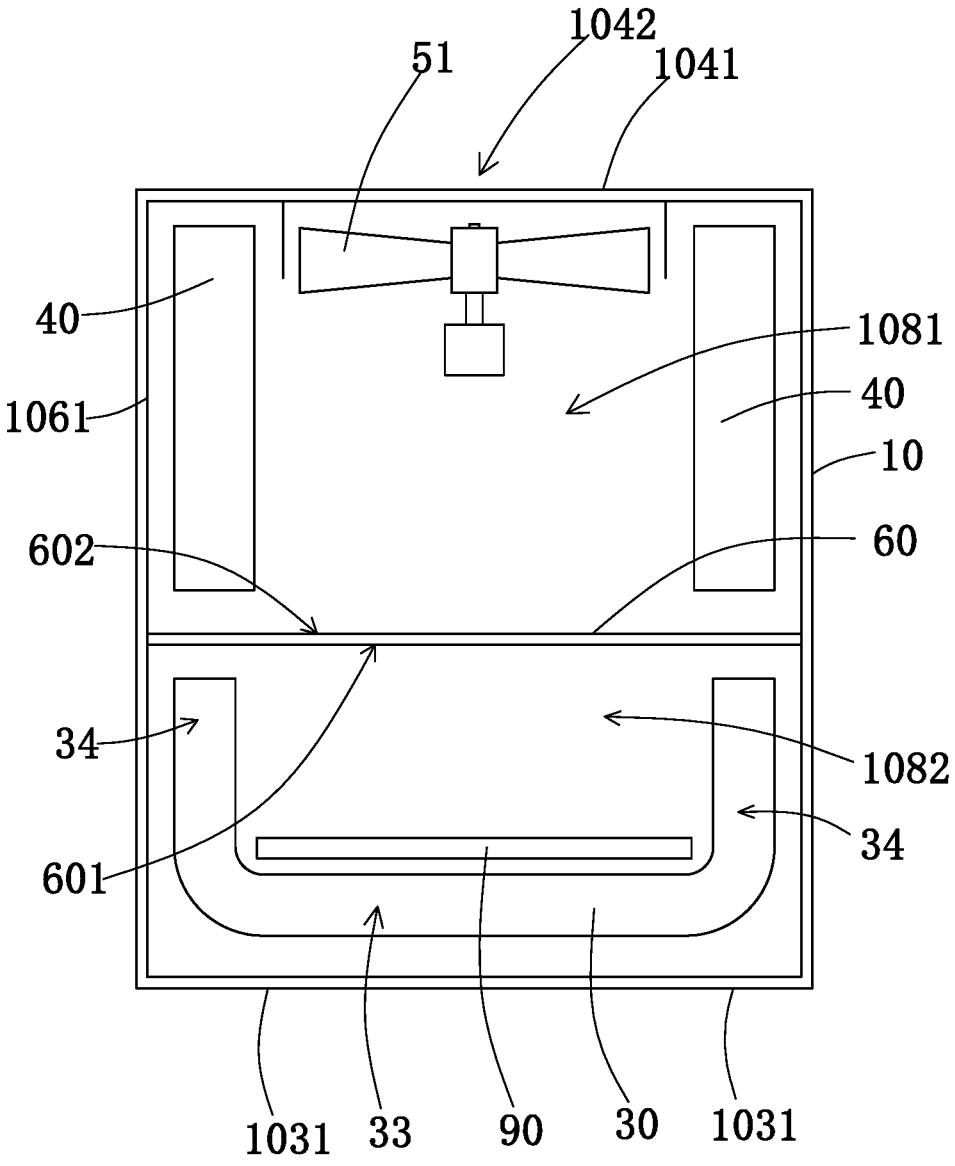
FIG. 8 is a sectional view of the air conditioning tower along line B-B of FIG. 3.

Referring to FIG. 2, FIG. 3, FIG. 7 to FIG. 9 of the drawings, the air conditioning tower of the present invention is utilized for providing air conditioning in an indoor space. The air conditioning tower may be embedded in a wall 80 of the indoor space. Unlike a conventional split-type air conditioning unit, there is no need to have an indoor air conditioning unit and an outdoor compressor unit. The tower casing 10 further comprises a divider 60 provided therein for dividing the entire receiving cavity 108 into a first section 1081 and a second section 1082. The first section 1081 refers to the space confined between a rear side 602 of the divider 60 and the rear panel 1041 of the tower casing 10. The second section 1082 refers to the space confined between a front surface 601 of the divider 60 and the front panel 1031 of the tower casing 10. As shown in FIG. 8 of the drawings, the evaporative cooling system 400 (except the pumping device 43), the centrifugal fan 50, and two cooling fans 51 are located in the first section 1081 of the tower casing 10. On the other hand, the heat exchanger 30, the compressor 20 and the pumping device 43 are located in the second section 1082 of the tower casing 10.

The air conditioning tower further comprises a dehumidifying device 90 supported at a position which is adjacent to the heat exchanger 30 for providing dehumidifying effect to the air which is being delivered to the indoor space, and an auxiliary cooling device 901 connected between the heat exchanger 30 and the evaporative cooling system 400. The auxiliary cooling device 901 is supported in the tower casing 10. The dehumidifying device 90 is connected to the heat exchanger 20 in parallel. The air conditioning tower further comprises a control valve 904 connected between the compressor outlet 21 and the dehumidifying device 90 for selectively controlling a flow of the refrigerant from the compressor 20 to the dehumidifying device 90.

Figure 9:
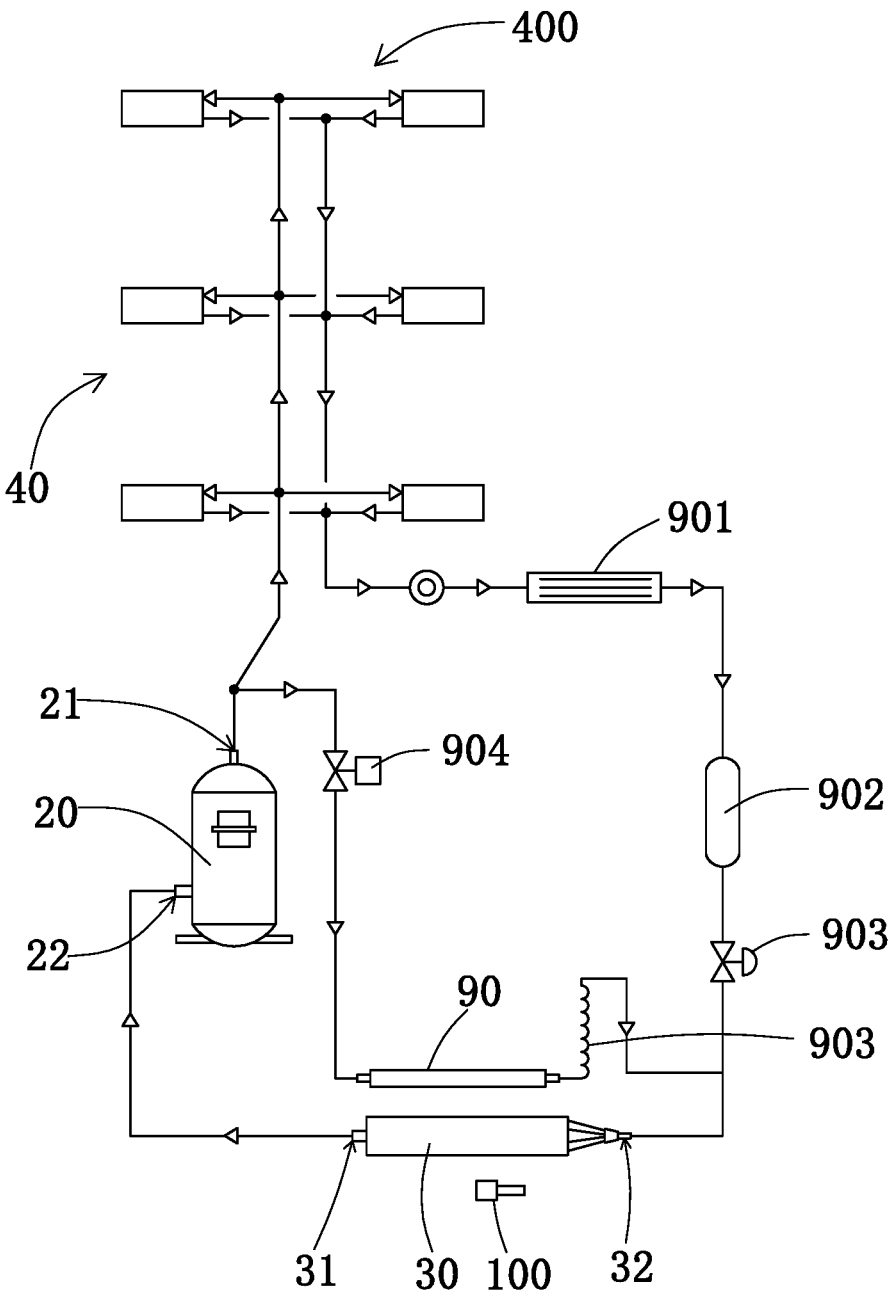
FIG. 9 is a schematic diagram of the air conditioning tower according to a preferred embodiment of the present invention, illustrating how the refrigerant flows through each component of the air conditioning tower.

Referring to FIG. 9 of the drawings, the flowing path of the refrigerant is illustrated. Refrigerant in its superheated state is delivered by the compressor 20 to flow into the first cooling unit 6, the second cooling unit 7 and the third cooling unit 8 of the evaporative cooling system 400. The refrigerant is arranged to perform heat exchange with the cooling water (as described above) and is cooled down and condensed by the evaporative cooling system 400. The condensed refrigerant is arranged to leave the evaporative cooling system 400 and enters the auxiliary cooling device 901 for further cooling. The refrigerant is then arranged to exit the auxiliary cooling device 901, pass through a filter 902, an expansion valve 903 and enter the heat exchanger 30 through the heat exchanging inlet 32. The refrigerant in the heat exchanger 30 is arranged to perform heat exchange with incoming air and absorb heat therefrom. The refrigerant is then evaporated again and leave the heat exchanger 30 through the heat exchanging outlet 31. The refrigerant leaving the heat exchanger 30 is arranged to flow back to the compressor 20 through the compressor inlet 22. This completes one heat exchange cycle for the refrigerant.

The air conditioning tower further comprises a humidifying sensor 100 provided on the tower casing 10 for sensing the humidity of the air in the indoor space. When the humidity in the indoor space reaches a predetermined threshold, the control valve 904 is actuated to allow a predetermined amount of superheated refrigerant coming out from the compressor outlet 21 to enter the dehumidifying device 90. The refrigerant releases heat to the air passing through the dehumidifying device 90 so as to extract water from the passing air. The refrigerant will then be condensed and guided to exit the dehumidifying device 90, pass through an expansion valve 903, and merge with the refrigerant coming from the auxiliary cooling device 901. The combined refrigerant in liquid state is arranged to enter the heat exchanger 30 and absorb heat from the air passing therethrough. The refrigerant is then guided to flow back to the compressor 20 in a manner described above.

Figure 10:
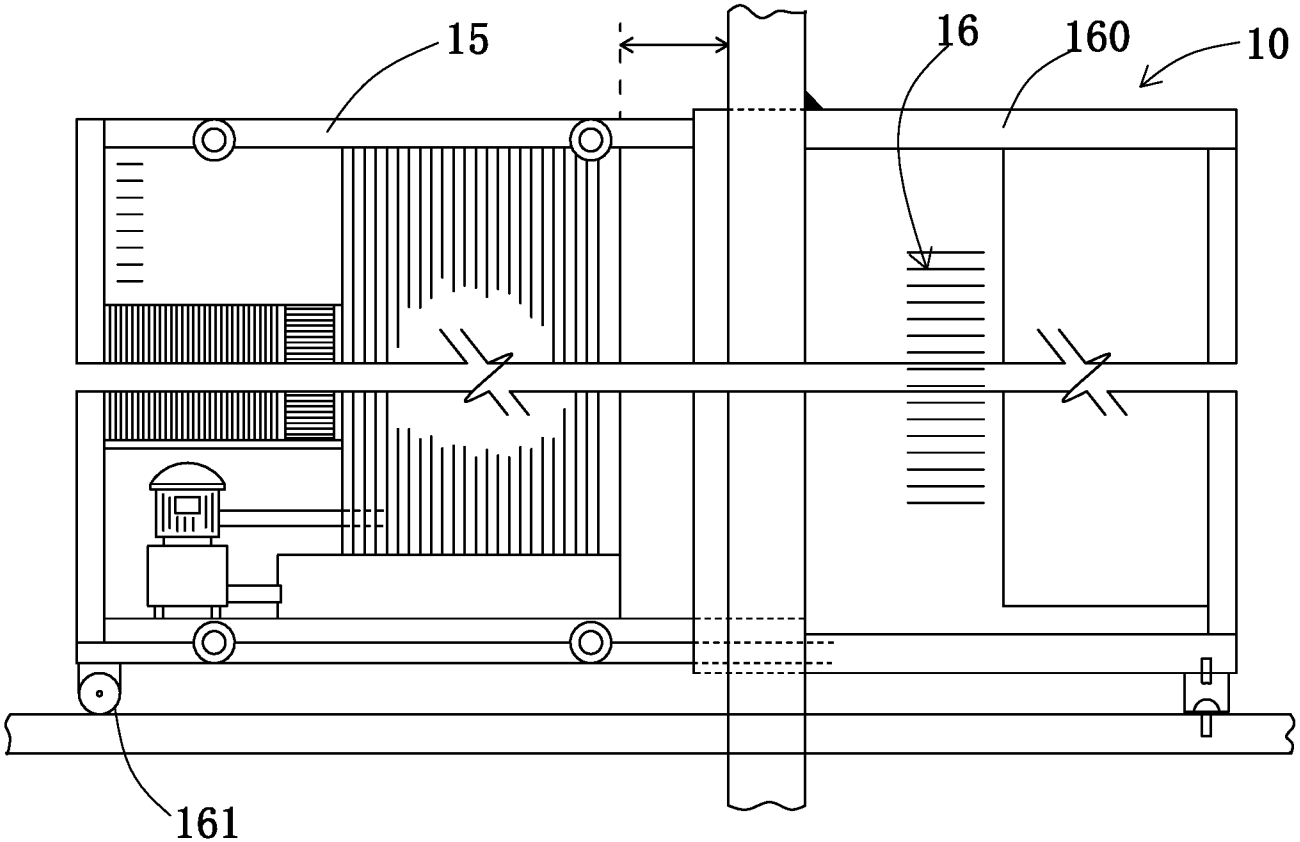
FIG. 10 is a schematic diagram of the air conditioning tower according to a preferred embodiment of the present invention, illustrating how the air conditioning tower may be installed.

Referring to FIG. 10 of the drawings, the air conditioning tower of the present invention may be installed on a wall 80. The main casing 10 may further comprise an external casing 160 and a supporting casing 15 supporting all the above-mentioned components of the air conditioning tower, and a plurality of wheels 161 connected to a bottom portion of the supporting casing 15. The supporting frame 15 may be slidably connected to the external casing 160. When it is slid out of the external casing 160, all the components of the air conditioning tower may be conveniently and easily maintained or repaired.

As may be appreciated, a feature of the present invention is that the air conditioning tower may be easily installed on premises. The air conditioning tower does not need to have any mounting devices for mounting the tower casing 10 to the wall 80. What is needed is just for a user of the present invention to form an opening on the wall 80 and then put the air conditioning tower in a proper position of the wall 80.

As shown in FIG. 2 and FIG. 8 of the drawings, when the air conditioning tower is in use, only the front panel 1031 and a little part of the first side panel 1051 and the second side panel 1061 of the tower casing 10 are exposed to the indoor space. As such, cooled air will be delivered to the indoor space through the air delivery outlet 12. Air in the indoor space is arranged to enter the tower casing 10 through the return air inlet 11. Some of the indoor air is guided to be exhausted to the ambient environment through a rear opening 1042 formed on the rear panel 104. The tower casing 10 further has two fresh air supply inlets 16 provided on the first side panel 1051 and the second side panel 1061 respectively. On the other hand, the heat exchanger 30 has a front heat exchanging portion 33 and two side heat exchanging portions 34 extended from two sides of the front heat exchanging portion 33, wherein the two side heat exchanging portions 34 are positioned to correspond to the fresh air supply inlets 16 respectively. Thus, fresh air from ambient environment is guided to enter the tower casing 10 through the fresh air supply inlets 16 and is arranged to perform heat exchange in the heat exchanger 30. The temperature of the ambient air will then be lowered and delivered to the indoor space through the air delivery outlet 12.

It is also important to emphasize that the air conditioning tower of the present invention may be distinguishable from conventional central air conditioning unit because the present invention does not need additional piping networks for delivering cooled air to indoor space. The present invention may directly deliver cooled air to the indoor space through the air delivery outlet 12.

The present invention, while illustrated and described in terms of a preferred embodiment and several alternatives, is not limited to the particular description contained in this specification. Additional alternative or equivalent components could also be used to practice the present invention.

What is claimed is:

1. An air conditioning tower, comprising:

a tower casing having a front portion, a rear portion, a first side portion, a second side portion, and a receiving cavity;

a compressor provided in said tower casing;

a heat exchanger provided in said receiving cavity of said tower casing and connected to said compressor, said heat exchanger extending across said front portion, said first side portion, and said second side portion of said tower casing;

an evaporative cooling system which comprises at least one multiple-effect evaporative condenser provided at least one of said first side portion and said second side portion of said tower casing, said multiple-effect evaporative condenser having an air inlet side and an opposed air outlet side, and comprising;

a pump provided at said bottom portion of said tower casing and adapted for pumping a predetermined amount of cooling water at a predetermined flow rate;

a first cooling unit, comprising:

a first water collection basin for collecting said cooling water from said pump, said first water collection basin having a first heat exchanging cavity and comprising a first inner basin member, and a first outer basin member, said first inner basin member comprising a first inner sidewall, a first inner bottom wall extended from said first inner sidewall to form a substantially L-shape cross section of said first inner basin member, and a first guiding wall extended from said first inner bottom wall so that said first inner bottom wall is extended between said first inner sidewall and said first guiding wall, said first inner basin member further comprising an inner partitioning wall upwardly extended from said first inner bottom wall at a position spacedly apart from said first inner sidewall, said first water inlet being formed at a bottom side of said first inner basin member at a position between said first inner sidewall and said inner partitioning wall;

a plurality of first heat exchanging pipes connected to heat exchanger and immersed in said first water collection basin; and a first fill material unit provided underneath said first heat exchanging pipes, wherein said cooling water collected in said first water collection basin is arranged to sequentially flow through exterior surfaces of said first heat exchanging pipes and said first fill material unit;

a second cooling unit, comprising:

a second water collection basin positioned underneath said first cooling unit for collecting said cooling water flowing from said first cooling unit;

a plurality of second heat exchanging pipes immersed in said second water collection basin and connected to said heat exchanger; and a second fill material unit provided underneath said second heat exchanging pipes, wherein said cooling water collected in said second water collection basin is arranged to sequentially flow through exterior surfaces of said second heat exchanging pipes and said second fill material unit; and a bottom water collecting basin positioned underneath said second cooling unit for collecting said cooling water flowing from said second cooling unit, said first inner basin member having a first water inlet connected to said pump so that said cooling water from said bottom water collection basin is capable of being pumped up to said first water collection basin through said first water inlet;

said cooling water collected in said bottom water collection basin being arranged to be guided to flow back into said first water collection basin of said first cooling unit, a predetermined amount of refrigerant circulating between said compressor, said heat exchanger, and said evaporative cooling system, said refrigerant from said heat exchanger being arranged to flow through said first heat exchanging pipes of said first cooling unit and said second heat exchanging pipes of said second cooling unit in such a manner that said refrigerant is arranged to perform highly efficient heat exchanging process with said cooling water for lowering a temperature of said refrigerant, a predetermined amount of air being drawn from said air inlet side for performing heat exchange with said cooling water flowing through said first fill material unit and said second fill material unit for lowering a temperature of said cooling water, said air having absorbed said heat from said cooling water being discharged out of said first fill material unit and said second fill material unit through said air outlet side; and a centrifugal fan provided in said tower casing for drawing air to flow from said air inlet side to said air outlet side.

2. The air conditioning tower, as recited in claim 1, wherein said first outer basin member comprises a first outer sidewall and a first outer bottom wall extended from said first outer sidewall at a position underneath said first inner bottom wall to form a substantially L-shaped cross section of said first outer basin member, a height of said first outer sidewall being greater than that of said first guiding wall, a height of said first inner sidewall being greater than that of said inner partitioning wall, said first heat exchanging pipes being accommodated in a space formed between said inner partitioning wall and said first guiding wall, said first water collection basin having a plurality of first passage holes spacedly formed on said first outer bottom wall.

3. The air conditioning tower, as recited in claim 2, wherein said first water collection basin further comprises a first water diverting panel provided in said first inner basin member at a position above said first heat exchanging pipes for diverting a water flowing route of said cooling water, said first water diverting panel being positioned such that a predetermined number of heat exchanging pipes are positioned on one side of said first water diverting panel, while said remaining first heat exchanging pipes are positioned on other side of said first water diverting panel.

4. The air conditioning tower, as recited in claim 3, wherein said first cooling unit further comprises a first guiding tray provided underneath said first fill material unit, and a first guiding panel provided underneath said first guiding tray for guiding a flowing path of said cooling water, said first guiding tray having a plurality of first guiding holes formed thereon, said first guiding panel comprising a first panel member, and a first blocking member upwardly extended from an end of said first panel member, wherein another end of said first panel member is a free end.

5. The air conditioning tower, as recited in claim 4, wherein each of said first heat exchanging pipes and said second heat exchanging pipes comprises a pipe body and a plurality of retention members spacedly formed in said pipe body, and a plurality of heat exchanging fins extended from an inner surface of said pipe body.

6. The air conditioning tower, as recited in claim 5, wherein each of said pipe bodies has two curved side portions and a substantially flat mid portion extending between said two curved side portions to form rectangular cross sectional shape at said mid portion, and two semicircular cross sectional shapes at two curved side portions of said corresponding said heat exchanging pipe.

7. The air conditioning tower, as recited in claim 6, wherein each of said retention members is spacedly distributed in said flat mid portion along a transverse direction of said corresponding pipe body so as to form a plurality of pipe cavities, each of said retention members having a predetermined elasticity for reinforcing said structural integrity of said corresponding heat exchanging pipe.

8. The air conditioning tower, as recited in claim 7, wherein each of said first heat exchanging pipes and said second heat exchanging pipes has a thin oxidation layer formed on an exterior surface and an interior surface thereof for preventing further corrosion of said corresponding heat exchanging pipe.

9. The air conditioning tower, as recited in claim 8, wherein each of said heat exchanging pipes has a thin layer of polytetrafluoroethylene formed on an exterior surface thereof to prevent unwanted substances from attaching on said exterior surfaces of said corresponding heat exchanging pipe.

10. The air conditioning tower, as recited in claim 4, wherein said first cooling unit further comprises a first guiding system which comprises a first inlet collection pipes extended between outer ends of said first heat exchanging pipes, a first guiding pipe extended between inner ends of said first heat exchanging pipes, and a first partitioning member provided in said first inlet collection pipe for blocking said refrigerant from passing through said first partitioning member.

11. The air conditioning tower, as recited in claim 10, wherein said first guiding system further comprises a plurality of first heat exchanging fins extended between each two adjacent first heat exchanging.

12. The air conditioning tower, as recited in claim 4, wherein said second cooling unit further comprises a second guiding system which comprises a second inlet collection pipes extended between outer ends of said second heat exchanging pipes, a second guiding pipe extended between inner ends of said second heat exchanging pipes, and a second partitioning member provided in said second inlet collection pipe for blocking said refrigerant from passing through said second partitioning member.

13. The air conditioning tower, as recited in claim 12, wherein said second guiding system further comprises a plurality of second heat exchanging fins extended between each two adjacent second heat exchanging pipes.

14. The air conditioning tower, as recited in claim 4, wherein said tower casing further comprises a divider provided therein for dividing said entire receiving cavity into a first section and a second section, said first section being defined as a space confined between a rear side of said divider and said rear panel of said tower casing, said second section being defined as a space confined between a front surface of said divider and said front panel of said tower casing.

15. The air conditioning tower, as recited in claim 4, further comprising a dehumidifying device supported at a position adjacent to said heat exchanger for providing dehumidifying effect to air delivered to said indoor space, and a control valve connected between said compressor and said dehumidifying device for selectively controlling a flow of said refrigerant from said compressor to said dehumidifying device, said dehumidifying device being connected to said heat exchanger in parallel.

16. The air conditioning tower, as recited in claim 15, further comprising an auxiliary cooling device connected between said heat exchanger and said evaporative cooling system.

17. The air conditioning tower, as recited in claim 15, further comprising a humidifying sensor provided on said tower casing, wherein when said humidity reaches a predetermined threshold, said control valve is actuated to allow a predetermined amount of refrigerant from said compressor to enter said dehumidifying device, said refrigerant in said dehumidifying device releasing heat to air passing through said dehumidifying device so as to extract water from said passing air, said refrigerant passing through said dehumidifying device being condensed and guided to exit said dehumidifying device, guided to flow to said heat exchanger.

18. The air conditioning tower, as recited in claim 4, wherein said tower casing further comprises an external casing, a supporting casing, and a plurality of wheels connected to said supporting casing, said supporting casing being slidably connected to said external, said compressor, said heat exchanger, said evaporative cooling system being supported by said supporting casing in a slidably movable manner with respect to said external casing.

19. The air conditioning tower, as recited in claim 4, wherein said tower casing further has two fresh air supply inlets provided on said first side panel and said second side panel respectively, said heat exchanger having a front heat exchanging portion and two side heat exchanging portions extended from two sides of said front heat exchanging portion, said two side heat exchanging portions being positioned to correspond to said fresh air supply inlets respectively.

20. An air conditioning tower, comprising:

a tower casing having a front portion, a rear portion, a first side portion, a second side portion, and a receiving cavity;

a compressor provided in said tower casing;

a heat exchanger provided in said receiving cavity of said tower casing and connected to said compressor, said heat exchanger extending across said front portion, said first side portion, and said second side portion of said tower casing;

an evaporative cooling system which comprises at least one multiple-effect evaporative condenser provided at least one of said first side portion and said second side portion of said tower casing, said multiple-effect evaporative condenser having an air inlet side and an opposed air outlet side, and comprising;

a pumping provided at said bottom portion of said tower casing and adapted for pumping a predetermined amount of cooling water at a predetermined flow rate;

a first cooling unit, comprising:

a first water collection basin for collecting said cooling water from said pump;

a plurality of first heat exchanging pipes connected to heat exchanger and immersed in said first water collection basin; and a first fill material unit provided underneath said first heat exchanging pipes, wherein said cooling water collected in said first water collection basin is arranged to sequentially flow through exterior surfaces of said first heat exchanging pipes and said first fill material unit;

a second cooling unit, comprising:

a second water collection basin positioned underneath said first cooling unit for collecting said cooling water flowing from said first cooling unit, said second water collection basin having a second heat exchanging cavity and comprising a second inner basin member, and a second outer basin member, said second inner basin member comprising a second inner sidewall, a second inner bottom wall extended from said second inner sidewall to form a substantially L-shape cross section of said second inner basin member, and a second guiding wall extended from said second inner bottom wall so that said second inner bottom wall is extended between said second inner sidewall and said second guiding wall, said second inner basin member further having a second water inlet for allowing said cooling water from said first cooling unit to flow into said second water collection basin, said second water inlet being formed at a top side of said second inner basin member, said second outer basin member comprising a second outer sidewall and a second outer bottom wall extended from said second outer sidewall at a position underneath said second inner bottom wall to form a substantially L-shaped cross section of said second outer basin member, a height of said second outer sidewall being greater than that of said second guiding wall, said second heat exchanging pipes being accommodated in a space formed between said second inner sidewall and said second guiding wall, said second water collection basin further having a plurality of second passage holes spacedly formed on said second outer bottom wall;

a plurality of second heat exchanging pipes immersed in said second water collection basin and connected to said heat exchanger;

a second fill material unit provided underneath said second heat exchanging pipes, wherein said cooling water collected in said second water collection basin is arranged to sequentially flow through exterior surfaces of said second heat exchanging pipes and said second fill material unit; and a second guiding tray provided underneath said second fill material unit, said second guiding tray having a plurality of second guiding holes formed thereon; and a bottom water collecting basin positioned underneath said second cooling unit for collecting said cooling water flowing from said second cooling unit, said cooling water collected in said bottom water collection basin being arranged to be guided to flow back into said first water collection basin of said first cooling unit, a predetermined amount of refrigerant circulating between said compressor, said heat exchanger, and said evaporative cooling system, said refrigerant from said heat exchanger being arranged to flow through said first heat exchanging pipes of said first cooling unit and said second heat exchanging pipes of said second cooling unit in such a manner that said refrigerant is arranged to perform highly efficient heat exchanging process with said cooling water for lowering a temperature of said refrigerant, a predetermined amount of air being drawn from said air inlet side for performing heat exchange with said cooling water flowing through said first fill material unit and said second fill material unit for lowering a temperature of said cooling water, said air having absorbed said heat from said cooling water being discharged out of said first fill material unit and said second fill material unit through said air outlet side; and a centrifugal fan provided in said tower casing for drawing air to flow from said air inlet side to said air outlet side.

21. The air conditioning tower, as recited in claim 20, wherein said second cooling unit further comprises a second guiding panel provided underneath said second guiding tray for guiding a flowing path of said cooling water coming from said second fill material unit, said second guiding panel comprising a second panel member, a second blocking member upwardly extended from an end of said second panel member, another end of said second panel member being a free end.

22. The air conditioning tower, as recited in claim 21, wherein each of said first heat exchanging pipes and said second heat exchanging pipes comprises a pipe body and a plurality of retention members spacedly formed in said pipe body, and a plurality of heat exchanging fins extended from an inner surface of said pipe body.

23. The air conditioning tower, as recited in claim 22, wherein each of said pipe bodies has two curved side portions and a substantially flat mid portion extending between said two curved side portions to form rectangular cross sectional shape at said mid portion, and two semicircular cross sectional shapes at two curved side portions of said corresponding said heat exchanging pipe.

24. The air conditioning tower, as recited in claim 23, wherein each of said retention members is spacedly distributed in said flat mid portion along a transverse direction of said corresponding pipe body so as to form a plurality of pipe cavities, each of said retention members having a predetermined elasticity for reinforcing said structural integrity of said corresponding heat exchanging pipe.

25. The air conditioning tower, as recited in claim 24, wherein each of said first heat exchanging pipes and said second heat exchanging pipes has a thin oxidation layer formed on an exterior surface and an interior surface thereof for preventing further corrosion of said corresponding heat exchanging pipe.

26. The air conditioning tower, as recited in claim 25, wherein each of said heat exchanging pipes has a thin layer of polytetrafluoroethylene formed on an exterior surface thereof to prevent unwanted substances from attaching on said exterior surfaces of said corresponding heat exchanging pipe.

27. The air conditioning tower, as recited in claim 21, wherein said first cooling unit further comprises a first guiding system which comprises a first inlet collection pipes extended between outer ends of said first heat exchanging pipes, a first guiding pipe extended between inner ends of said first heat exchanging pipes, and a first partitioning member provided in said first inlet collection pipe for blocking said refrigerant from passing through said first partitioning member.

28. The air conditioning tower, as recited in claim 27, wherein said first guiding system further comprises a plurality of first heat exchanging fins extended between each two adjacent first heat exchanging.

29. The air conditioning tower, as recited in claim 21, wherein said second cooling unit further comprises a second guiding system which comprises a second inlet collection pipes extended between outer ends of said second heat exchanging pipes, a second guiding pipe extended between inner ends of said second heat exchanging pipes, and a second partitioning member provided in said second inlet collection pipe for blocking said refrigerant from passing through said second partitioning member.

30. The air conditioning tower, as recited in claim 29, wherein said second guiding system further comprises a plurality of second heat exchanging fins extended between each two adjacent second heat exchanging pipes.

31. The air conditioning tower, as recited in claim 21, wherein said tower casing further comprises a divider provided therein for dividing said entire receiving cavity into a first section and a second section, said first section being defined as a space confined between a rear side of said divider and said rear panel of said tower casing, said second section being defined as a space confined between a front surface of said divider and said front panel of said tower casing.

32. The air conditioning tower, as recited in claim 21, further comprising a dehumidifying device supported at a position adjacent to said heat exchanger for providing dehumidifying effect to air delivered to said indoor space, and a control valve connected between said compressor and said dehumidifying device for selectively controlling a flow of said refrigerant from said compressor to said dehumidifying device, said dehumidifying device being connected to said heat exchanger in parallel.

33. The air conditioning tower, as recited in claim 32, further comprising an auxiliary cooling device connected between said heat exchanger and said evaporative cooling system.

34. The air conditioning tower, as recited in claim 32, further comprising a humidifying sensor provided on said tower casing, wherein when said humidity reaches a predetermined threshold, said control valve is actuated to allow a predetermined amount of refrigerant from said compressor to enter said dehumidifying device, said refrigerant in said dehumidifying device releasing heat to air passing through said dehumidifying device so as to extract water from said passing air, said refrigerant passing through said dehumidifying device being condensed and guided to exit said dehumidifying device, guided to flow to said heat exchanger.

35. The air conditioning tower, as recited in claim 21, wherein said tower casing further comprises an external casing, a supporting casing, and a plurality of wheels connected to said supporting casing, said supporting casing being slidably connected to said external, said compressor, said heat exchanger, said evaporative cooling system being supported by said supporting casing in a slidably movable manner with respect to said external casing.

36. The air conditioning tower, as recited in claim 21, wherein said tower casing further has two fresh air supply inlets provided on said first side panel and said second side panel respectively, said heat exchanger having a front heat exchanging portion and two side heat exchanging portions extended from two sides of said front heat exchanging portion, said two side heat exchanging portions being positioned to correspond to said fresh air supply inlets respectively.

* * * * *